US005216193A

United States Patent [19]

Masubuchi

[11] Patent Number: 5,216,193

[45] Date of Patent: Jun. 1, 1993

[54] BENDING ANGLE DETECTOR AND ELECTRONIC MUSICAL INSTRUMENT EMPLOYING IT

[75] Inventor: Takamichi Masubuchi, Hamamatsu, Japan

[73] Assignee: Yamaha Corporation, Hamamatsu, Japan

[21] Appl. No.: 677,776

[22] Filed: Mar. 29, 1991

[30] Foreign Application Priority Data

Mar. 30, 1990 [JP] Japan ..... 2-83704

[51] Int. Cl.[5] ..... G10H 1/06; G10H 1/18; G10H 5/00

[52] U.S. Cl. ..... 84/600; 84/616; 84/626; 73/862.68; 338/99

[58] Field of Search ..... 84/600, 615, 616, 622, 84/644, DIG. 7, DIG. 8; 73/862.68; 338/99; 128/782, 774

[56] References Cited

U.S. PATENT DOCUMENTS

| | | | |
|---|---|---|---|
| 4,444,205 | 4/1984 | Jackson | 128/782 |
| 4,635,516 | 1/1987 | Giannini | 84/600 |
| 4,715,235 | 12/1987 | Fukui et al. | 338/99 |
| 4,977,811 | 12/1990 | Suzuki et al. | 84/600 |
| 5,005,460 | 4/1991 | Suzuki et al. | 84/600 |
| 5,029,508 | 7/1991 | Suzuki et al. | 84/616 |

FOREIGN PATENT DOCUMENTS 0264782 10/1987 European Pat. Off. .

OTHER PUBLICATIONS

Shoji Morimoto; Kazuo Tuchiya; *Japanese Study*, Sep. 1988.

*Primary Examiner*—William M. Shoop, Jr.
*Assistant Examiner*—H. Kim
*Attorney, Agent, or Firm*—Graham & James

[57] ABSTRACT

A bending angle detector is constructed by a flexible base member, a flexible resistor and a detecting circuit. Herein, the flexible resistor is attached on at least one surface of the base member so that the resistance thereof can be varied in response to a bend of the base member. The detecting circuit, coupled to the flexible resistor, detects a bending angle of the base member based on the resistance variation of the flexible resistor. In an electronic musical instrument employing this bending angle detector, there is provided a flexible mounting member having a shape to be put on an articulation portion of a person. At least one storage pouch is formed at the predetermined position of the flexible mounting member to store the bending angle detector therein. Thus, a musical tone signal is formed based on a bending angle of the articulation portion of the person detected by the bending angle detector. Preferably, the flexible mounting member has a glove-like-shape.

7 Claims, 6 Drawing Sheets

BENDING ANGLE DETECTOR AND ELECTRONIC MUSICAL INSTRUMENT EMPLOYING IT

BACKGROUND OF THE INVENTION

1. Field of the Invention

The present invention relates to a bending angle detector which detects a bending angle of an articulation portion of a person, and also relates to an electronic musical instrument employing it.

2. Prior Art

As known well, a non-electronic musical instrument generates a sound by striking a string, a key or by blowing in general. Most of the electronic musical instruments generate a sound by playing a keyboard attached thereto.

If a musical tone can be generated in accordance with a natural motion of a person, it may be possible to perform the music, regardless of the playing technique required for the conventional musical instrument. If so, it is possible to take the new pleasure in the musical performance or it is possible to obtain a brand-new performance effect. However, the conventional musical instrument cannot be performed, regardless of the playing technique. For this reason, there is a strong demand to develop a new electronic musical instrument.

Meanwhile, a bending motion of the articulation portion of the person, such as his fingers, wrist, elbow and shoulder is a general and natural motion of the person, which is frequently used in a dancing. Therefore, if the musical tone can be controlled based on such motion of the person, it may be possible to control the musical tone, regardless of the playing technique.

In order to satisfy the above-mentioned demand, the present applicant has proposed a new type of the electronic musical instrument which can control the musical tone in response to the bending motion of the person's hand, leg etc., which is disclosed in Japanese Patent Laid-Open Publication No. 1-167891. FIGS. 1A, 1B show a construction of a bending angle detector which is used to detect the bending angle of the articulation portion of the person in the electronic musical instrument. In FIGS. 1A, 1B, casings 1, 2 are fixed at respective positions along a finger such that the finger articulation will be located between them. In addition, resistor plates 3, 4 are provided in the casings 1, 2 respectively. Further, a sliding plate 5 is movably provided between the casings 1, 2 such that brushes attached to both edges thereof are in contact with the resistor plates 3, 4 respectively. When the finger is bent as shown in FIGS. 1A, 1B, a distance between the casings 1, 2 along the finger is elongated, so that the brushes of the sliding plate 5 move on the resistor plates 3, 4 respectively. In this case, the brushes and resistor plates 3, 4 function as a linear-slide-type variable resistor. Thus, the resistance will be varied in accordance with the movement of the brush to be moved on the resistor plate. Based on the resistance variation, the bending angle of the finger is detected.

The above-mentioned bending angle detector is constructed such that two casings must be fixed at respective positions at both sides of the finger articulation. Therefore, there is a drawback in that it is troublesome for the person to attach and remove the detector, or such construction of the detector prevents the smooth motion of the finger. Further, due to the movable construction of the detector in which both edges of the sliding plate 5 must be slid on the resistor plates 3, 4, there is another drawback in that scale, width and weight of the detector must be inevitably enlarged.

SUMMARY OF THE INVENTION

It is accordingly a primary object of the present invention to provide a bending angle detector having simple structure, thin construction and light-weight which can be attached to and removed from the person with ease.

It is another object of the present invention to provide an electronic musical instrument employing the above-mentioned bending angle detector.

In a first aspect of the present invention, there is provided an electronic musical instrument employing a bending angle detector comprising:

a base member formed by flexible material;

at least one resistor attached at one surface of the base member, the resistor having a flexibility by which the resistor can be bent with a bend of the base member and also having a resistance which is varied in response to a bend of the base member;

a detecting circuit, coupled to the resistor, for detecting a bending angle of the base member based on resistance variation of the resistor; and a musical tone generator for generating a musical tone based on said bending angle detected by said detecting circuit.

In a second aspect of the present invention, there is provided an electronic musical instrument employing the above-mentioned bending angle detector comprising:

a flexible mounting member having a shape by which an articulation portion of a person is to be covered;

a storage pouch, provided at a predetermined portion of the flexible mounting member, for storing the base member therein such that the base member can be bent in response to a bend and a stretch of the articulation portion of the person; and musical tone forming means for forming a musical tone signal based on an output signal of the detecting circuit representing a bending angle of the articulation portion of the person.

BRIEF DESCRIPTION OF THE DRAWINGS

Further objects and advantages of the present invention will be apparent from the following description, reference being had to the accompanying drawings wherein the preferred embodiment of the present invention is clearly shown.

In the drawings.

DESCRIPTION OF THE PREFERRED EMBODIMENTS

Next, description will be given with respect to the preferred embodiment of the present invention.

[A] Construction of Bending Angle Detector

Figure 1A:
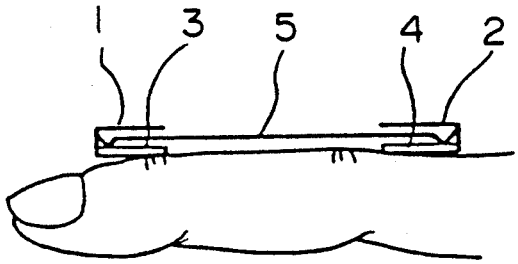
FIG.1A (PRIOR ART)
FIGS. 1A, 1B are side views each showing a diagramatical construction of the conventional bending angle detector.
Figure 1B:
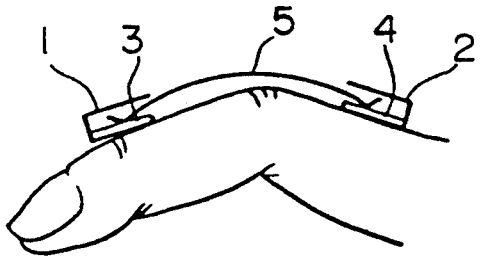
FIG.1B (PRIOR ART)
Figure 3:
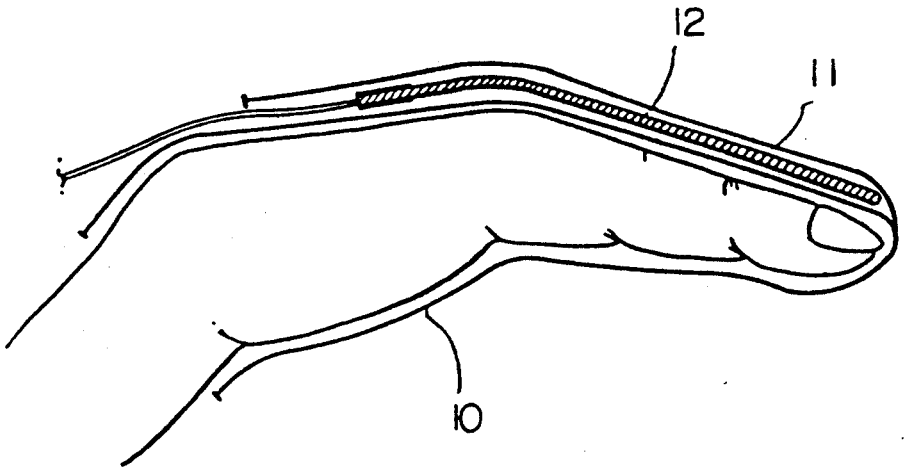
FIG. 3 is a sectional view showing a part of the bending angle detector shown in FIG. 2.
Figure 2:
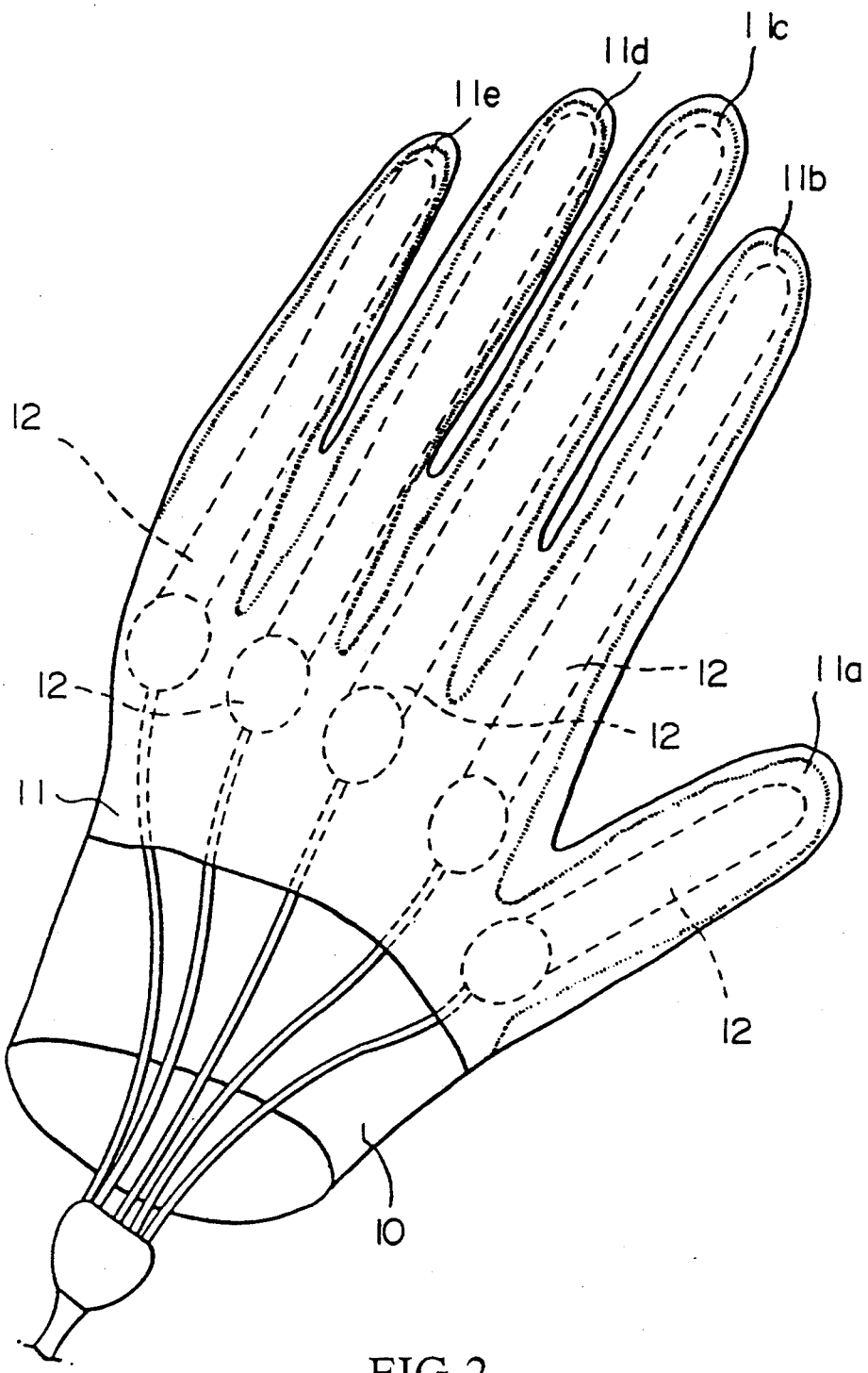
FIG. 2 is a perspective side view showing construction of a bending angle detector according to an embodiment of the present invention.
Figure 4:
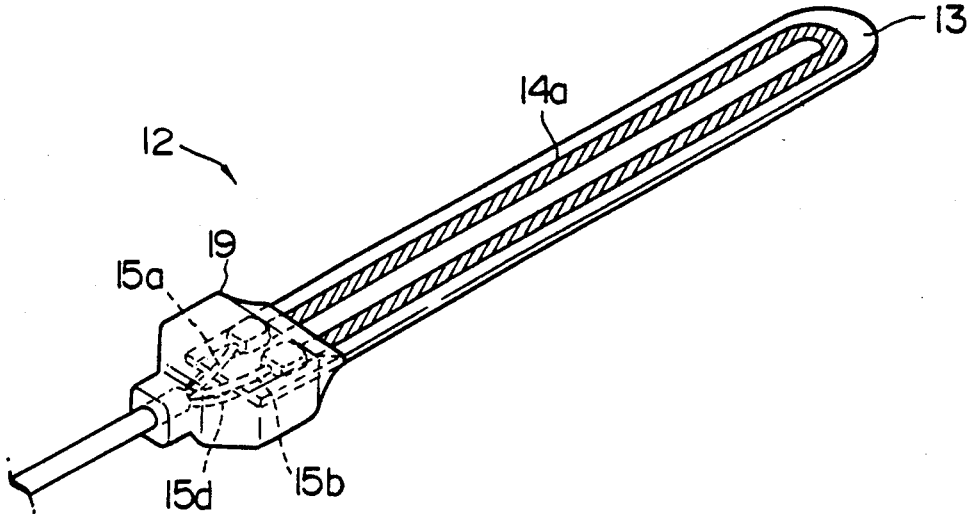
FIG. 4 is a perspective side view showing an essential part of the bending angle detector.
Figure 5:
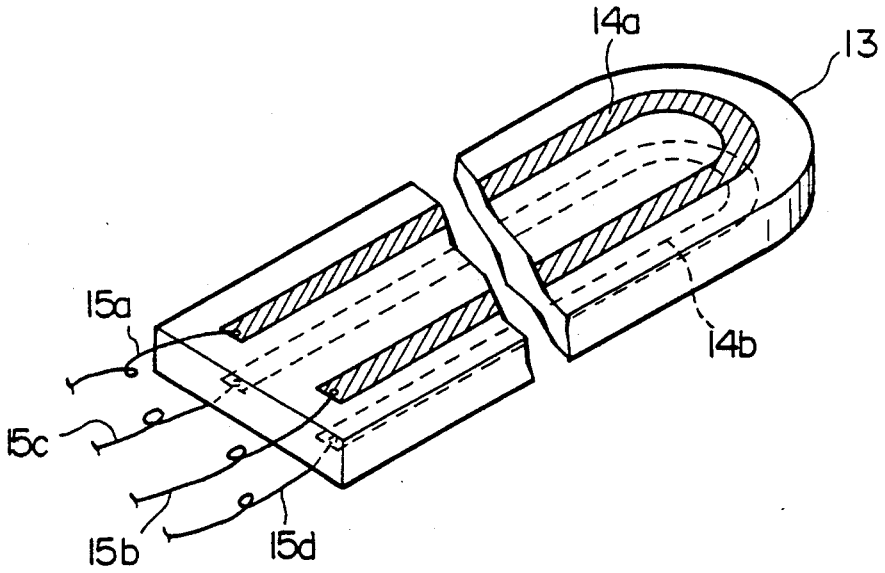
FIG. 5 is a magnified view of FIG. 4.
Figure 6:
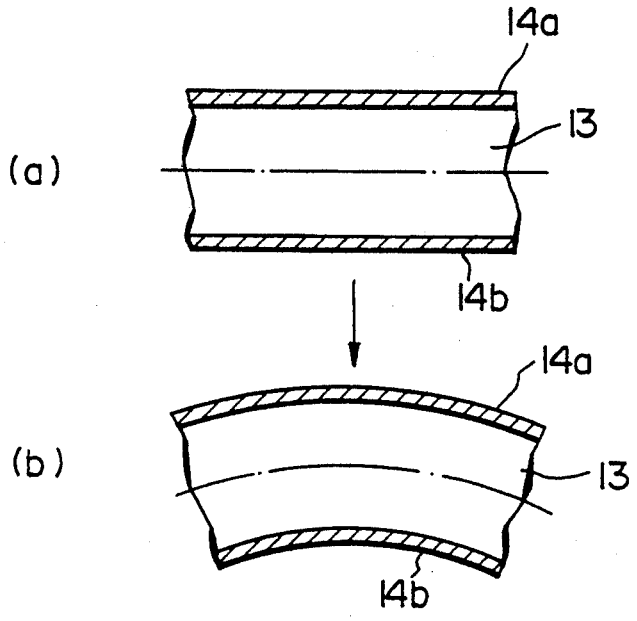
FIG. 6 is a cross sectional view showing a part of a base member shown in FIGS. 4 and 5.

FIG. 2 is a perspective side view showing a glove-type bending angle detector according to an embodiment of the present invention, and FIG. 3 is a sectional view showing a detailed construction of the bending angle detector. Herein, 10 designates a glove sewed by flexible cloth. In addition, a cover 11 made by the same flexible cloth is sewed at the hand-back portion of the glove 10, so that a double structure is formed. Due to such double structure, there are provided storage pouches 11*a* to 11*e*. Herein, each storage pouch is formed independent of the other pouches, and a detector element 12 as shown in FIGS. 4, 5 is stored in each pouch. In FIGS. 4 and 5, 13 designates a base member which is formed as an elongated thin plate having the sufficient insulation and flexibility. Herein, U-shape resistors 14*a*, 14*b* each having the forward and backward paths are respectively attached at upper and lower sides of the base member 13. In addition, leads 15*a* to 15*d* are respectively connected to both edges of the resistors 14*a*, 14*b*, and a cover 19 is provided such that it covers the connecting portions between the resistors 14*a*, 14*b* and leads 15*a* to 15*d*. Each of the above-mentioned resistors 14*a*, 14*b* is made by the material (e.g., carbon particles) which has the flexibility and which resistance is varied in response to the expansion and contraction applied thereto. When the base member 13 is bent as shown in FIGS. 6(*a*), 6(*b*), the upper-side resistor 14*a* is expanded so that its resistance is increased, while the lower-side resistor 14*b* is contracted so that its resistance is decreased. Such resistance variations of the resistors 14*a*, 14*b* is occurred in response to the bending angle of the base member 13, which is detected by a detecting circuit shown in FIG. 7.

Figure 7:
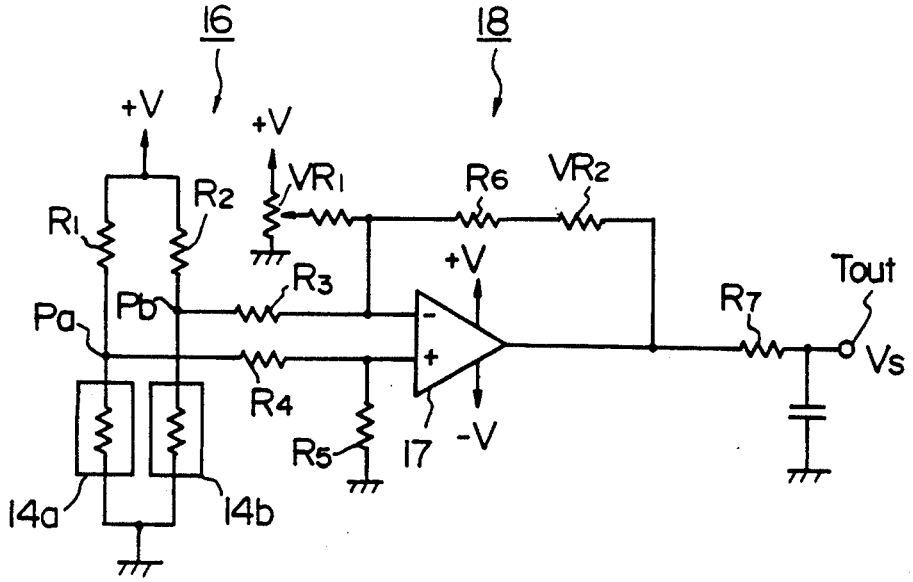
FIG. 7 is a circuit diagram showing an electric configuration of a detecting circuit used in the bending angle detector.

In FIG. 7, 16 designates a conversion portion which converts the resistance variations of the resistors 14*a*, 14*b* into voltages. This conversion portion 16 is configured in form of the bridge circuit wherein first edges of resistors R1, R2 are coupled to a power source +V, second edges of resistors R1, R2 are respectively coupled to first edges of the resistors 14*a*, 14*b*, and second edges of the resistors 14*a*, 14*b* are grounded. In addition, voltage applied between a connection point Pa at which the resistors R1, 14*a* are connected together and another connection point Pb at which the resistors R2, 14*b* are connected together is detected by a differential amplifier 18 which is configured by an operational amplifier 17, resistors R3 to R7 and variable resistors VR1, VR2. Then, an output voltage of the differential amplifier 18 is outputted from an output terminal Tout as a detection voltage Vs corresponding to the bending angle of the base member 13. Incidentally, the variable resistor VR1 is provided to adjust the offset gain. Due to this variable resistor VR1, the detection voltage Vs is adjusted at zero level when the resistances of the resistors 14*a*, 14*b* are equal to each other. On the other hand, another variable resistor VR2 is provided to adjust the gain, in other words, it is provided to adjust the level of the detection voltage Vs.

[B] Electronic Musical Instrument (1) Configuration

Figure 8:
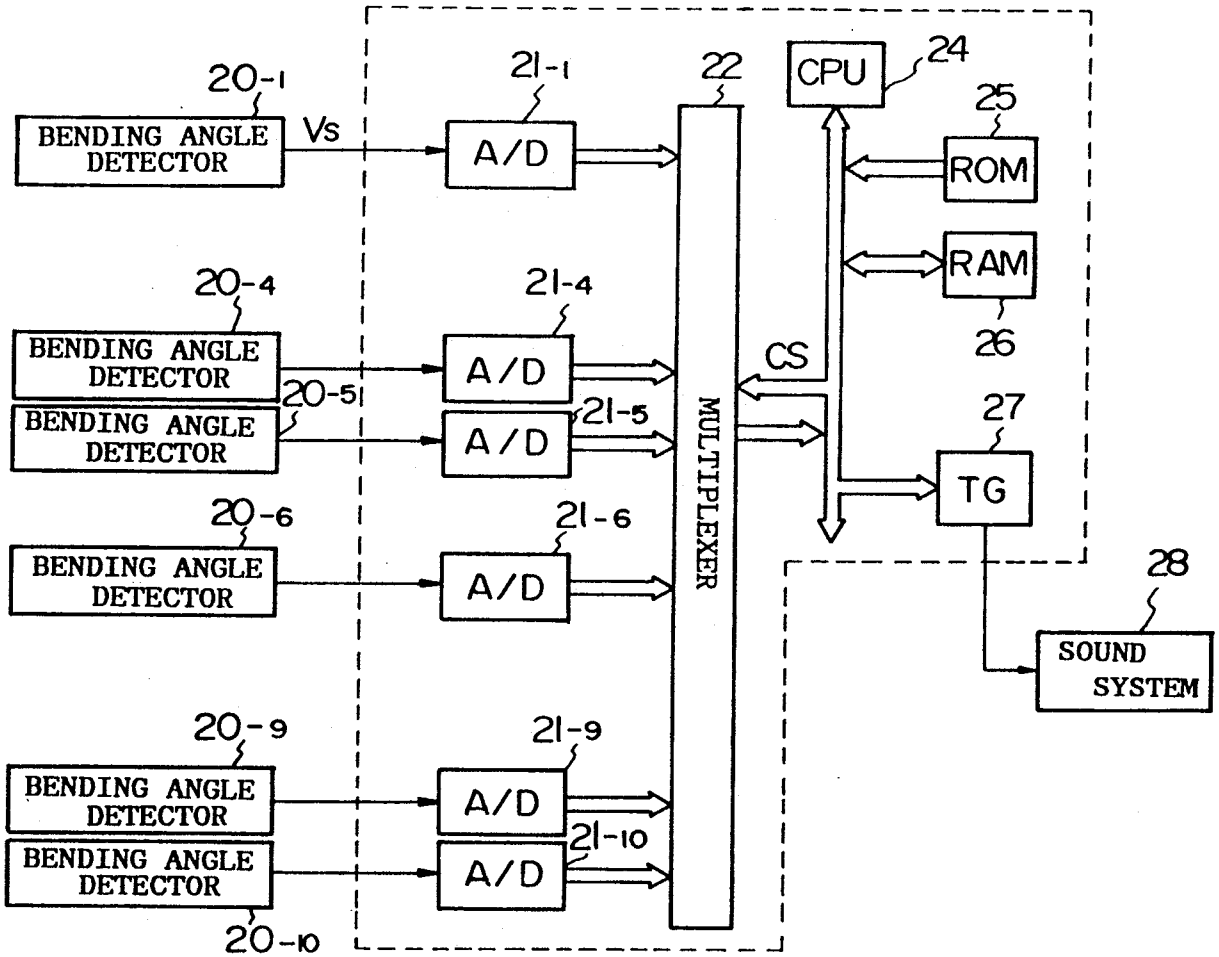
FIG. 8 is a block diagram showing an electric configuration of an electronic musical instrument employing the bending angle detector according to an embodiment of the present invention.

Next, description will be given with respect to an electronic musical instrument employing the above-mentioned bending angle detector according to an embodiment of the present invention by referring to FIG. 8.

In FIG. 8, 20-1 to 20-5 designate bending angle detectors each detecting the bending angle of each finger of the right hand, wherein 20-1 corresponds to the thumb and 20-5 corresponds to the little finger. Similarly, 20-6 to 20-10 designate bending angle detectors each detecting the bending angle of each finger of the left hand, wherein 20-6 corresponds to the thumb and 20-10 corresponds to the little finger. Each of them is configured by the detector element 12 (see FIGS. 4, 5) and detecting circuit as shown in FIG. 7, wherein the detector element 12 is stored in each of the storage pouches 11*a* to 11*e* of the glove 10 as shown in FIG. 2.

Each of the bending angle detectors 20-1 to 20-10 outputs the detection voltage Vs to each of analog-to-digital converters (A/D) 21-1 to 21-10. Each A/D converter is designed to convert the detection voltage Vs into digital data formed by the predetermined number of bits. Such digital data from the A/D converters 21-1 to 21-10 (hereinafter, simply referred to as 10-channel digital data) are supplied to a multiplexer 22. Based on a channel select signal CS supplied to a select terminal of the multiplexer 22, the multiplexer 22 selects one of 10-channel digital data.

Meanwhile, 24 designates a central processing unit (CPU), 25 designates a read-only memory (ROM) which stores programs to be executed in CPU 24, and 26 designates a random-access memory (RAM) to be used as a work area for data and programs. The CPU 24 sequentially varies the channel select signal CS to thereby scan 10-channel digital data with high speed. Then, 10-channel digital data to be scanned are stored in the RAM 26 as tone volume data AMP1 to AMP10. In addition, 27 designates a tone generator (TG) which can generate 10-channel musical tone signals in time-sharing manner. Herein, the predetermined pitches (e.g., C1 to E2) are assigned to respective channels. Thus, the tone generator 27 sequentially outputs the musical tones each having the pitch assigned to each channel and also having the level corresponding to the tone volume data AMP1 to AMP10 each supplied to each channel from the CPU 24. Such musical tone signals are sequentially supplied to a sound system 28. This sound system 28 is configured by an amplifier, which amplifies the musical tone signal supplied thereto from TG 27, and a speaker, which is driven by the amplified musical tone signal.

(2) Operation

Figure 9:
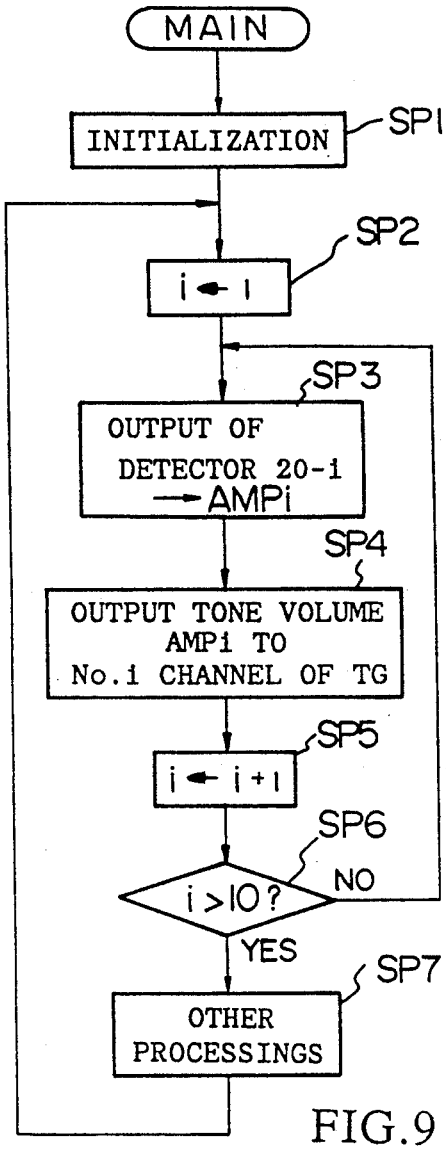
FIG. 9 is a flowchart used for explaining an operation of the electronic musical instrument shown in FIG. 8.

Next, description will be given with respect to an operation of the above-mentioned electronic musical instrument by referring to a flowchart shown in FIG. 9.

When a power switch (not shown) is on, the CPU 24 performs an initialization in step SP1. Then, the processing proceeds to step SP2 wherein value of "i" representing a channel to be processed is set at "1". In next step SP3, the predetermined channel select signal CS is supplied to the multiplexer 22 to thereby designate the bending angle detector 20-1 which detects the bending angle of the thumb of the right hand. Thus, output data of the bending angle detector 20-1 is stored in the RAM 26 as the tone volume data AMP1. Then, the processing proceeds to step SP4 wherein the tone volume data AMP1 is supplied to first channel of TG 27, so that the speaker of the sound system 28 generates a musical tone having the pitch C1 assigned to the first channel and also having the tone volume corresponding to the bending angle of the thumb of the right hand. In this case, as the bending angle of the finger becomes sharper, the tone volume becomes larger. Thereafter, "i" is incremented by one in step SP5, and then the processing proceeds to step SP6 wherein it is judged whether or not "i" becomes larger than "10". In case of "i > 10", the processing proceeds to step SP7. In other cases, the processing returns back to step SP3. Thus, until step SP6 judges "i > 10", the foregoing operations of steps SP3 to SP5 are repeatedly performed. After performing these operations for ten channels, the processing proceeds to step SP7 wherein the other processings are executed. Thereafter, the processing returns back to step SP2 again.

According to the above-mentioned operations, the musical tone is generated in the pitch which is varied from C1 to E1 by respectively bending the thumb, . . . , little finger of the right hand and thumb, . . . , little finger of the left hand, wherein the tone volume becomes larger as the finger is bent sharper.

In the present embodiment, the pitch is designated by the finger to be bent, and the tone volume is varied in response to the bending angle of the finger. Moreover, it is possible to modify the present embodiment such that the reverberation effect and other musical parameters can be controlled by the bending motion of the finger. Or, it is possible to control several kinds of the musical parameters in response to the bending velocity of each finger, wherein the bending velocity is computed based on the unit-time variation rate of the resistor 14*a*, 14*b*.

[C] Modifications

Next, description will be given with respect to the modifications of the present invention as follows.

Figure 10:
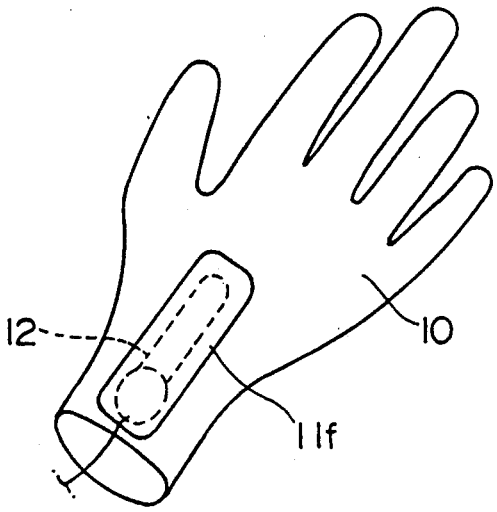
FIG. 10 is a perspective side view showing a modified example of the bending angle detector.

(1) It is possible to modify the bending angle detector according to the present invention such that the bending angle can be detected at the wrist articulation. In this case, as shown in FIG. 10, a storage pouch 11*f* is provided at the hand-back portion of the glove 10 near the wrist articulation, and a detector element 12 is inserted in this pouch 11*f*.

(2) It is possible to modify the bending angle detector such that the bending angle can be detected at the articulations of the elbow and shoulder. In this case, a detector element 12 is inserted in a storage pouch provided at a supporter which covers such articulation portion. Similar modification can be made to the bending angle detector such that the bending angle can be detected at the other articulations of the knee, ankle etc.

Incidentally, it is possible to apply the above-mentioned bending angle detector in the field of the remote control of the magic hand, motion analysis of the human, and the like, other than the field of the electronic musical instrument.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. An electronic musical instrument employing a bending angle detector comprising:

a mounting member formed by flexible material;

at least one resistor formed by flexible material, said resistor being constrained to bend with said mounting member and having at least one end movable with respect to said mounting member, and also having a resistance which is varied in response to bending or straightening of said resistor;

a detecting circuit, coupled to said resistor, for detecting a bending angle of said resistor based on resistance variation of said resistor; and a musical tone generator for generating a musical tone based on said bending angle detected by said detecting circuit.

2. An electronic musical instrument which comprises:

a mounting member formed by flexible material; and having a shape by which a joint of a person can be covered;

at least one resistor formed by flexible material, said resistor being constrained to bend with said mounting member and having at least one end movable with respect to said mounting member, and also having a resistance which is varied in response to bending or straightening of said resistor;

a detecting circuit, coupled to said resistor, for detecting a bending angle of said resistor based on resistance variation of said resistor;

a storage pouch, provided at a predetermined portion of said flexible mounting member, for storing said resistor therein such that said resistor is constrained to bend or straighten in response to bending or straightening, respectively, of said joint; and musical tone forming means for forming a musical tone signal based on an output signal of said detecting circuit representing a bending angle of said joint.

3. An electronic musical instrument as defined in claim 2 wherein said flexible mounting member having a glove-like-shape so that said flexible mounting member can be put on a hand of the person.

4. An electronic musical instrument as defined in claim 3 wherein said storage pouch is formed along with a finger portion of the glove-like-shape flexible mounting member so that said bending angle detector stored therein is provided along with the finger portion to detect a bending angle of a finger of the person.

5. An electronic musical instrument as defined in claim 3 wherein said storage pouch is formed at a wrist portion of the person so that said bending angle detector stored therein is provided at the wrist portion to detect a bending angle of a wrist of the person.

6. An electronic musical instrument as defined in claim 2 wherein said musical tone forming means forms a musical tone signal having a parameter that is controlled in response to the bending angle detected by said detecting circuit.

7. An electronic musical instrument as defined in claim 4 wherein movement of a particular finger is employed to control a musical tone signal having a predetermined musical pitch and the volume of said musical tone signal is determined by the bending angle of said finger.

* * * * *